US007225589B1

(12) United States Patent
Smith

(10) Patent No.: US 7,225,589 B1
(45) Date of Patent: Jun. 5, 2007

(54) ANCHOR BOLT PLACEMENT AND PROTECTION DEVICE

(76) Inventor: James R. Smith, Northwest Plastics, P.O.Box 993636, Redding, CA (US) 96099-3636

( * ) Notice: Subject to any disclaimer, the term of this patent is extended or adjusted under 35 U.S.C. 154(b) by 399 days.

(21) Appl. No.: 10/335,656

(22) Filed: Dec. 31, 2002

(51) Int. Cl.
*E02D 7/00* (2006.01)
*E04H 12/00* (2006.01)

(52) U.S. Cl. ..... 52/292; 52/295; 52/297; 52/301; 52/698

(58) Field of Classification Search ..... 52/699, 52/700, 704, 300–301, 303, 292, 295–297, 52/698; 249/93, 91, 190, 34, 48; 248/231.9, 248/231.91, 354.3, 499–500
See application file for complete search history.

(56) References Cited

U.S. PATENT DOCUMENTS

| | | | | | |
|---|---|---|---|---|---|
| 2,760,272 | A | * | 8/1956 | Van Cantie | 33/518 |
| 3,552,734 | A | * | 1/1971 | Severino et al. | 269/287 |
| 4,614,070 | A | * | 9/1986 | Idland | 52/296 |
| 5,060,436 | A | * | 10/1991 | Delgado, Jr. | 52/295 |
| 5,240,224 | A | * | 8/1993 | Adams | 249/93 |
| D363,657 | S | * | 10/1995 | Kassardjian et al. | D8/354 |
| 5,670,076 | A | * | 9/1997 | Leek | 249/53 M |
| 5,813,188 | A | * | 9/1998 | Behlen | 52/699 |
| 6,431,517 | B1 | * | 8/2002 | Chapman | 249/93 |

FOREIGN PATENT DOCUMENTS

JP 2002-97645 A * 4/2002

* cited by examiner

*Primary Examiner*—Carl D. Friedman
*Assistant Examiner*—Tan Le
(74) *Attorney, Agent, or Firm*—JonesTullarCooper, PC; John J. Leavitt

(57) ABSTRACT

Presented is an anchor bolt placement and protection device to facilitate setting of anchor bolts in concrete to facilitate placement of a mud sill. It is important that the anchor bolts that secure a mud sill to a foundation be properly spaced from the outside edge of the foundation. In one embodiment there is provided a device having a tubular projection open at one end to receive the threaded end of an anchor bolt. Projecting integrally from the bottom open end of the tubular projection are two lateral projections. One is adapted to place an anchor bolt when a 2×4 mud sill is used. The second projection positions the anchor bolt at the proper distance to receive a 2×6 mud sill. A second embodiment is provided with a single lateral projection extending perpendicularly from the open bottom end of the tubular projection. The top surface of the lateral extension is provided with cross-ribs and indicia that indicate the proper placement of either a 2×4 or 2×6 mud sill. A third embodiment provides a second laterally extending plate member in alignment with the first but on the opposite side of the tubular projection. Both extensions are provided with transverse ribs indicating the proper location of the device in relation to the underlying form boards.

11 Claims, 6 Drawing Sheets

ANCHOR BOLT PLACEMENT AND PROTECTION DEVICE

BACKGROUND OF THE INVENTION

This invention relates broadly to concrete foundations and the foundation form boards between which the concrete is poured, and more particularly relates to mud sill anchor bolts and structural hardware bolts that are embedded in the concrete and to an anchor bolt placement device adapted to be detachably mounted on the threaded end of the anchor bolt and which functions to shield the threads from being coated with concrete during the pour and to properly position the anchor bolt in relation to the form boards between which concrete is poured.

DESCRIPTION OF THE PRIOR ART

It is well known that concrete is poured between concrete form boards that are usually set into trenches that accommodate the wooden forms which retain the concrete while it hardens. It has been the practice in industry to place a wooden spacer bar between the form boards at the bottom of the trench and to nail a cleat across the top edges of the form boards to retain the proper spacing of the form boards while concrete is being poured between the form boards. While it is expected that the bottom spacer bars will be of the appropriate length to retain the bottom edges of the form boards appropriately spaced apart within the bottom of the trench in which they lie, held there by the pressure of dirt filled into the trench against the outside surfaces of the form boards, it has been found that the utilization of wooden cleats nailed to overlap across the top edges of the form boards frequently results in inaccurate spacing between the top edges of the form boards. The reason is that one end portion of the cleat must be nailed to the top edge of one form board after which the workman needs to manipulate a measuring rule between the inner surfaces of the top edge portions of the form boards while placing a second nail through the cleat and into the remaining form board while attempting to retain the two form boards at the appropriate spacing. This procedure is expensive in terms of the materials that are used and the time that must be expended by a workman to affect a proper spacing of the top edges of the form boards. Another of the disadvantages of this method of spacing and retaining the upper edges of the form boards is that frequently workmen are paid for the number of linear feet of forms they erect. This motivates the workmen to work quickly, thus contributing to the improper spacing of the top edges of the form boards or improper nailing of the cleats. Another disadvantage is that during pouring of the concrete into the form, the cleats are an obstruction to the agitation of the concrete to remove bubbles from the concrete and also form an obstruction to the trowels used to smooth the top edge of the concrete to secure a relatively smooth surface for the placement of the mud sill to be anchored on the top of the foundation or concrete slab by the anchor bolts set into the concrete. In that connection, various systems have been utilized to support anchor bolts supported in relation to the top edges of form boards while concrete is being poured. An other disadvantage encountered is that the position of the anchor bolt is frequently misjudged, thus increasing the difficulty of boring holes in the mud sill to accommodate the anchor bolts. In addition to misplacement or irregular misplacement between successive anchor bolts, another problem of the old system of setting the anchor bolts is that the depth to which they are set is frequently not uniform. Sometimes the anchor bolts are set so deeply that the threaded end of the anchor bolt does not project through the thickness of the mud sill. Other times, the threaded end of the anchor bolt projects too far above the mud sill, requiring numerous washers to provide a surface falling within the threaded portion of the anchor bolt so that a nut may be threaded onto the anchor bolt to retain the mud sill after it is placed over the anchor bolt.

Accordingly, it is one of the important objects of the present invention to provide an anchor bolt placement device that cooperates with the threaded end of the anchor bolt to properly position the anchor bolt at the requisite spacing in relation to the inner surface of the form board and to the appropriate depth for the thickness of the mud sill to be thereafter placed over the anchor bolt and to prevent the anchor bolt threads from being contaminated by concrete during the pour.

Depending on the nature of the structure being constructed, foundation walls are frequently dimensioned to receive 2"×4" or 2"×6" mud sills. Usually, the mud sill is a redwood beam that must be bored at appropriate intervals to accept the threaded ends of the anchor bolts projecting vertically from the top surface of the foundation or concrete slab. Accordingly, another object of the invention is the provision of a device that detachably envelops and frictionally engages the exposed threaded end of the anchor bolt and which includes at least one lateral projection to appropriately and accurately space the anchor bolt from the inside surface of the form board so that all of the anchor bolts are uniformly spaced, thus facilitating the boring of the mud sill so that the holes therein are appropriately spaced to match the spacing between the anchor bolts and any structural hardware bolts.

Still another object of the invention is the provision of a pre-manufactured device that may be frictionally slipped over the threaded end of the anchor bolt to a predetermined depth and which provides a latterly extending portion that when deployed for use properly spaces the anchor bolt from the inside surface of the form board to selectively receive a 2"×6" mud sill and a second latterly extending portion that when deployed for reception of a 2"×4" mud sill properly positions the anchor bolt in relation to the inside surface of an associated form board.

Yet another object of the invention is the provision of a pre-manufactured unitary or monolithic anchor bolt placement device including a tubular projection adapted to be slipped detachably over the threaded end of an anchor bolt to prevent the threads from being coated by concrete, the anchor bolt having a right angle projection at its bottom end to retain the anchor bolt in the concrete, the placement device having lateral integral extensions on both sides of the tubular projection and including indicia indicating the proper spacing of the upper edges of the form boards for both 2"×4" and 2"×6" mud sills provided with pre-bored holes to receive nails to temporarily anchor the integral extending portions to the top edges of the form boards so as to retain the form boards at the proper spacing.

The invention possesses other objects and features of advantage, some of which with the foregoing, will be apparent from the following description and the drawings. It is to be understood however that the invention is not limited to the embodiments illustrated and described, since it may be embodied in various forms within the scope of the appended claims.

SUMMARY OF THE INVENTION

In terms of broad inclusion, the invention is embodied in three different embodiments to facilitate the setting of anchor bolts in a concrete foundation or concrete slab, or properly set structural hardware bolts of the type used to prevent a residence from slipping off the foundation as the result of an earthquake or hurricane, for instance. It should be understood that anchor bolts for "stick" built residential homes and for prefabricated residential homes, are placed in concrete foundations that are usually six inches thick for single story homes, and eight inches thick for two and three story homes. For a six inch thick foundation, a 2"×4" mud sill is frequently used to form the plate on which floor rafters or beams are supported, but a six inch wide mud sill could also be used. For an eight-inch foundation, it is usual to utilize a 2"×6" mud sill to form the plate on which floor rafters or beams are supported but an eight-inch mudsill could also be used.

The width of the mud sill and the dimension of wall studs are usually determined by a calculation of energy loss which is in turn determined by the type and thickness of insulation placed between the wall studs and structural engineering which can vary from building to building. It is thus important that the anchor bolts that secure the mud sill to the foundation be properly spaced from the outside edge of the foundation so that the anchor bolts pass through the longitudinal center of the mud sill. It is therefore necessary for the workmen that construct a concrete foundation form and set the anchor bolts to not only properly space the form boards one from the other so that the inside surfaces of the form boards are properly spaced, but it is also necessary that the workmen that set the anchor bolts set them the proper distance from the inside surface of the form board that defines the outside surface of the foundation.

In this regard, Section 2607, paragraph D of the Uniform Building Code mandates that supports, reinforcements, prestressing of steel and ducts be accurately placed and adequately supported before concrete is poured and be secured against displacement within permitted tolerances. The invention described and illustrated herein facilitates meeting these stringent requirements. Anchor bolts are nominally ½", or ⅝" or ¾" in diameter and approximately eight inches to ten inches in length with a right angle bend at the bottom end of the anchor bolt that is embedded in the concrete to provide an abutment within the bed of concrete to withstand the tensile force imposed on the bolt when the anchor bolt nut is tightened. In the first embodiment of the invention there is provided a device having a tubular projection open at one end to receive the threaded proximate end of the anchor bolt and closed or otherwise terminated at the opposite end to limit penetration of the anchor bolt to correspond with the length thereof projecting above the concrete that extends through the thickness of the mud sill and dimensioned in internal diameter to frictionally slip over the threaded proximate end of the anchor bolt to a distance to provide the appropriate length of anchor bolt projecting above the mud sill to receive a fastener such as a threaded nut.

Projecting integrally from the bottom open end of the tubular projection of the device, at right angles to each other, are two lateral projections one of which is adapted to determine the proper placement of the anchor bolt when a 2"×4" mud sill is to be used while the second projection at 90° to the first has a length that positions the anchor bolt at the proper distance from the inside surface of the form board associated with the outside surface of the foundation to provide placement of the anchor bolt generally at the center of a 2"×6" mud sill. The two projections are flat on their bottom sides, and rest lightly on the surface of the concrete when the anchor bolt is pressed into the concrete while it is still moist and plastic. After the concrete sets, it is a simple matter to withdraw the detachable device from the threaded end of the anchor bolt while leaving the anchor bolt in its proper position and with clean threads not contaminated with concrete. The anchor bolt placement device, once removed, can be used again on another job.

In the second embodiment, the anchor bolt placement device is again provided with a tubular projection having an open bottom end and a closed or otherwise terminated top end with a single lateral projection extending integrally and perpendicularly from the open bottom end of the tubular projection. The top surface of the lateral extension is provided with cross-ribs associated with indicia that indicate the proper placement of either a 2"×4" or 2"×6" mud sill, and appropriate pre-dilled holes are provided in the lateral extension through which nails may be driven to temporarily attach the device to the associated top edge of a form board so as to retain the anchor bolt in proper position until the concrete hardens, at which time the device is removed for reuse. In the third embodiment, there is again provided a tubular projection that is closed or otherwise terminated at its top end and open at its bottom end and which provides aligned lateral integral extensions on opposite sides of the tubular projection. The lateral extension from one side of the center tubular projection is provided on its top surface with cross-ribs as previously discussed in connection with the second embodiment to mark the placement of the inside surface of the form board for both 2"×4" and 2"×6" mud sills and with pre-drilled holes to temporarily attach the extension to the top edge of the associated form board. The extension on the opposite side of the tubular extension is likewise provided with laterally extending cross-ribs spaced apart along the length of the extension and provided with pre-drilled holes for temporarily attaching the end of the extension to the top edge of the opposite form board. This device performs the triple functions of preventing contamination of the threads by concrete, properly spacing the anchor bolt from the inside edge of the associated form board and to retain the form boards at the proper spacing to thus in one device, in cooperation with an appropriate anchor bolt, eliminating three separate procedures or functions that would normally have to be performed to properly space and set anchor bolts in concrete in relation to form boards.

DETAILED DESCRIPTION OF PREFERRED EMBODIMENTS

At the outset, it is to be understood that when 2"×4" and 2"×6" members are mentioned, these are the "nominal" dimensions of unfinished lumber or beams. In actuality, finished lumber is somewhat smaller in size although it is still called by the same nomenclature. Thus, a 2" by 4" beam is generally only 1½" thick and 3¾" wide. On the other hand, a 2"×6" is only 1½" thick and 5½" wide. Nevertheless, even though these are the finished dimensions of these structural members, they are still called by their standard nomenclature as indicated above. In utilizing redwood for mud sills, it is common practice to use 2"×4" mud sills anchored to a six-inch wide foundation for single story dwellings. On the other hand, for multi-story dwellings, such as two-story and three-story dwellings, it is common practice to use an eight-inch wide foundation wall and a 2"×6" mud sill. Again, it should be understood that different dimensions can be used for foundations and mud sills without departing from the spirit of the invention. In either case, it is the best practice to set the anchor bolts for the concrete foundation or concrete slab so that they are spaced midway between the edges of the mud sills of whatever width. Stated in other words, it is better practiced to bore the holes to receive the anchor bolts along the centerline of these timbers and at intervals that are specified in the building plans. In almost all construction, one edge of the mud sill is placed so that it is flush with the outside wall of the foundation or slab. This enables waterproofing material to be nailed to the vertical wall studs to extend past the joint between the mud sill and the top of the foundation or slab, thus preventing the passage of water underneath the mud sill and into the crawl space below the sub-floor of the structure when a stem foundation is utilized or below the slab.

Figure 2:
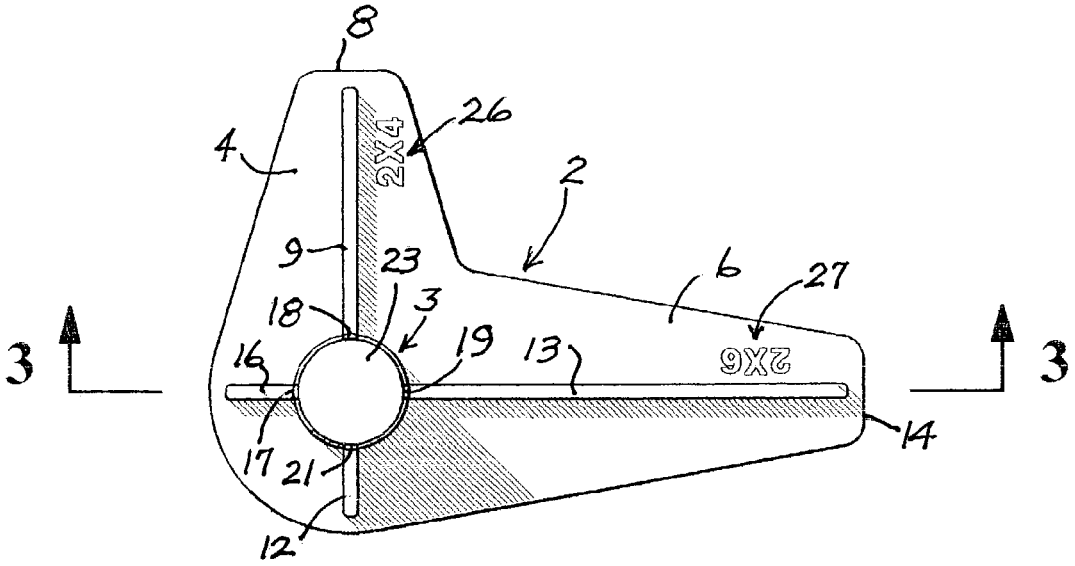
FIG. 2 is a top plan view of the anchor bolt placement device illustrated in FIG. 1.
Figure 12:
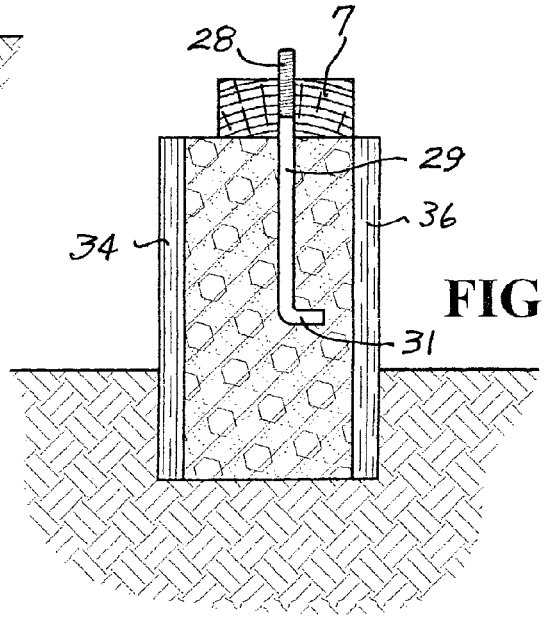
FIG. 12 is a view similar to FIG. 11 but illustrating a 2"×4" mud sill imposed on the anchor bolt.

Referring to FIGS. 1 through 12 that embody and illustrate the anchor bolt positioning or placement device of the first embodiment of the invention, it is noted that this embodiment is a pre-manufactured unitary or monolithic device injection molded from an appropriate synthetic resinous material that is tough and impact resistant, such as a phenolic, and is formed to provide a flat base portion designated generally by the numeral 2 and an integral vertically extending generally tubular projection integral with the base member and designated generally by the numeral 3. As seen in FIG. 2, the base member includes two laterally extending integral plate portions 4 and 6 extending at right angles to each other. The center lines of the two plate portions, if extended, would cross coincident with the central axis of the tubular projection 3. The extension 4 is utilized to measure the distance from the inner face of the form board or the outer face of the concrete foundation wall or the outside edge of a concrete slab to the center of the anchor bolt for a 2" by 4" mud sill 7 as illustrated in FIG. 12, this distance being approximately 1¾" from the central axis of the vertical projection 3 and the end edge 8 of the laterally projecting plate portion 4. It should be noted that the anchor bolt placement device of FIGS. 1–12 performs two important functions, first, to envelope the threads of the anchor bolt and prevent contamination thereof by concrete and, second, to properly place the anchor bolt spaced from the associated form board. Additionally, to strengthen the plate portion 4, an integral reinforcing rib 9 is provided extending from the outer wall of the vertically projecting tubular member 3 to the end edge 8 of the extension arm 4. As illustrated in FIG. 2, the rib 9 is continued on the opposite side of the tubular member 3 in a portion 12.

In like manner and again referring to FIG. 2, it is noted that the laterally extending plate portion 6 is somewhat longer than the plate portion 4 and its length is calculated to correspond to the proper spacing for the anchor bolts used for a 2"×6" mud sill. As with the laterally extending member 4, the laterally extending plate portion 6 is provided with a reinforcing rib 13 which extends from the tubular projection 3 to near the end edge 14 of the plate portion 6. The rib 13 is continued on the opposite side of the tubular projection 3 in an extension 16. To further reinforce the structure, specifically to reinforce the upwardly extending tubular member 3, ribs 17, 18, 19 and 21 extend vertically and integrally up the sides of the tubular member 3 at 90° intervals around the periphery thereof, and their bottom ends terminate at, and are integral with, the ribs 16, 9, 13 and 12, respectively, so as to provide rigidity to the completed device. As stated previously, the upwardly extending tubular projection 3 is provided with an open end 22 and a closed end 23.

Figure 4:
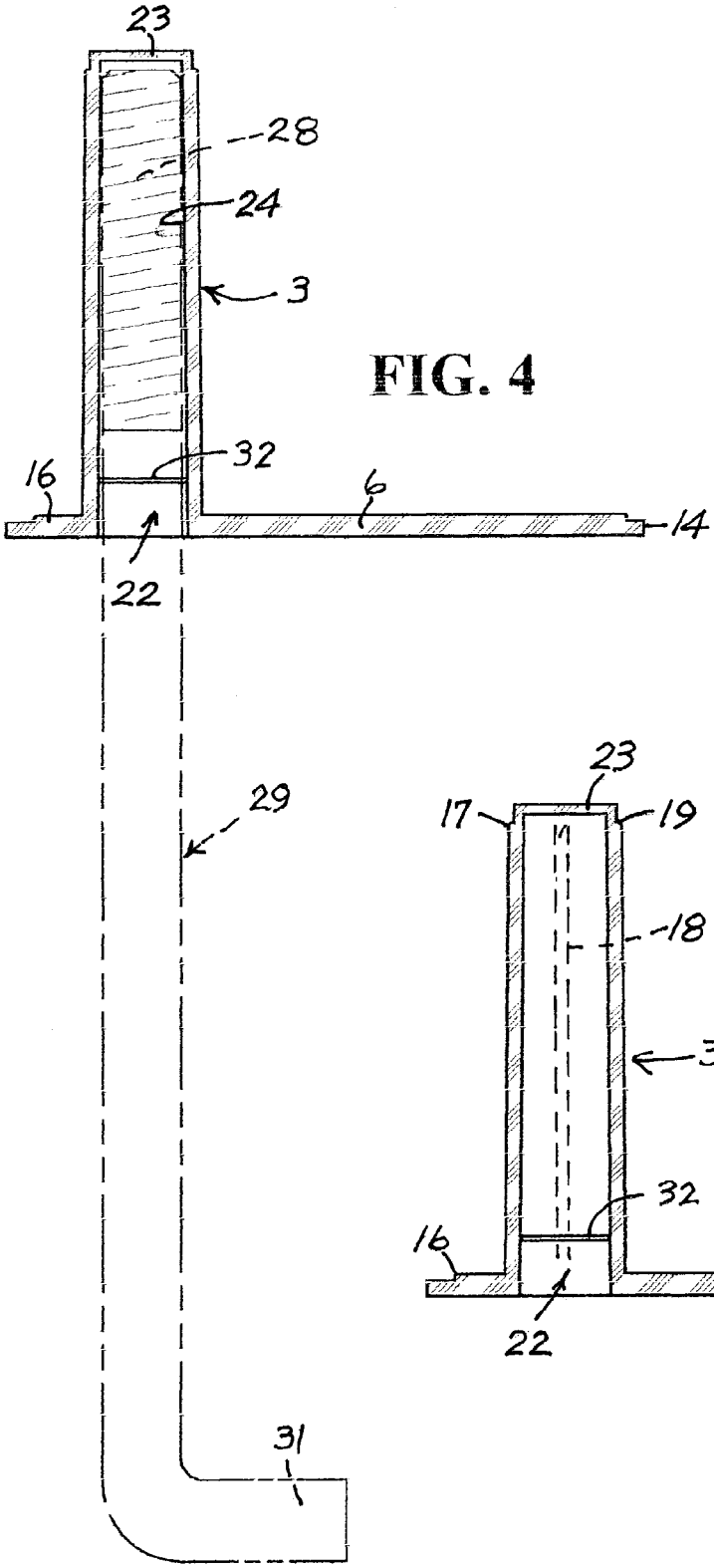
FIG. 4 is a vertical cross-sectional view similar to FIG. 3 but showing the anchor bolt placement device mounted on the threaded end of an anchor bolt, the anchor bolt being shown in broken lines.
Figure 3:
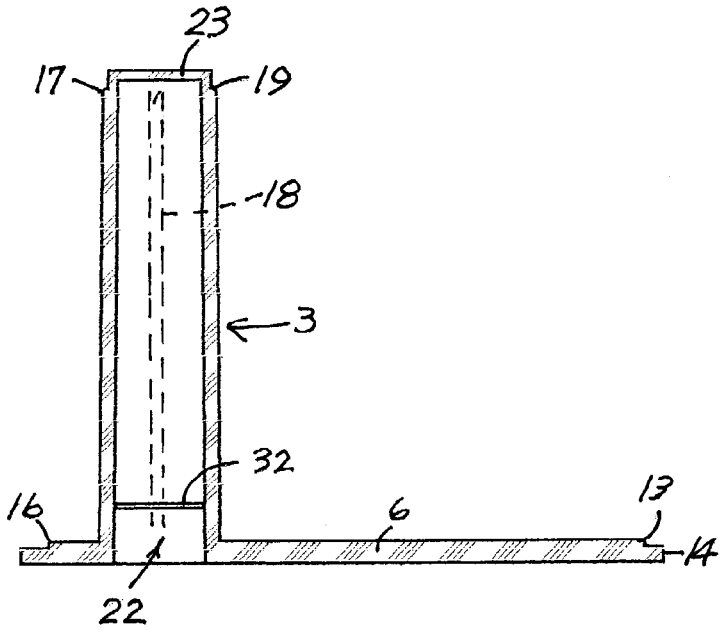
FIG. 3 is a vertical cross-sectional view taken in the plane indicated by the line 3—3 in FIG. 2.

It will also be noted that the interior wall 24 of the upwardly projecting tubular member 3 is provided with a slight draft to enable injection molding of the unitary device and extraction of the completed device from the mold. Note also that the upwardly projecting tubular member 3 is integral at its bottom end with the laterally extending plate portions 4 and 6 and the ribs reinforcing these members. Additionally, it should be noted that the plate portion 4 is marked with the indicia "2×4" designated by numeral 26 while the plate portion 6 is marked with the indicia "2×6" designated by the numeral 27. These indicia indicate to the workmen the appropriate dimensions for setting anchor bolts for either 2"×4" or 2"×6" mud sills. As seen in FIG. 4, the anchor bolt placement device 3 is slipped over the threaded end 28 of an anchor bolt designated generally by the numeral 29 and which is equipped with a laterally extending abutment portion 31 which when embedded in the concrete as illustrated in FIGS. 5–12, anchors the anchor bolt in the concrete against the tension imposed on the anchor bolt by the application of an appropriate nut (not shown) to the threaded portion 28 after the mud sill 7 (FIG. 12) is applied to the anchor bolt after the concrete hardens.

In the interest of clarity, the nut and washer usually applied to the anchor bolt to retain the mud sill are not shown, however since the anchor bolt placement device is frictionally slipped over the threaded end of the anchor bolt as illustrated in FIG. 4, it should be noted that the interior periphery 24 of the upwardly projecting tubular member 3 is provided adjacent its lower open end with an annular rib 32 formed integrally on the inner periphery of the tubular member 3 and functions to frictionally engage the outer peripheral surface of the anchor bolt when the device 2 is slipped over the threaded end thereof while enabling the anchor bolt placement device to be pulled off of the anchor bolt after the anchor bolt is properly set in the concrete.

Figure 5:
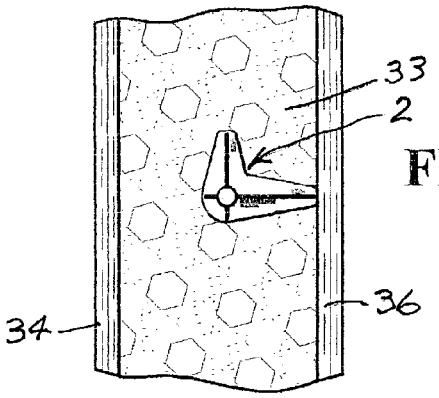
FIG. 5 is a top plan view in reduced size of the device illustrated in FIG. 2 shown in association with an anchor bolt embedded in concrete and illustrating the manner in which the device functions to place the anchor bolt properly for reception of a 2"×6" mud sill.
Figure 7:
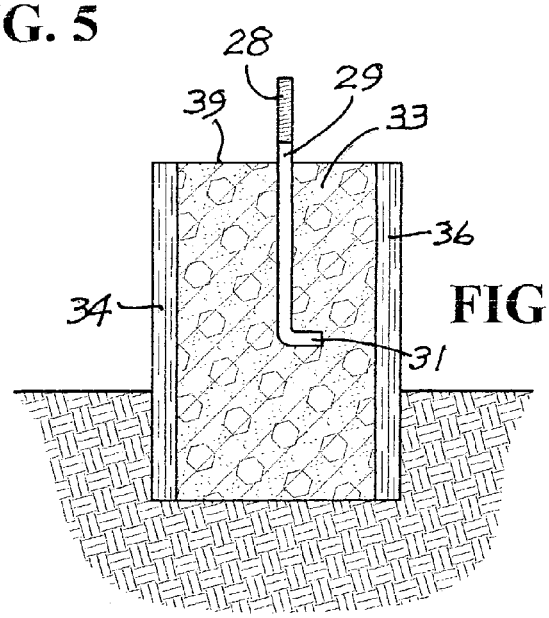
FIG. 7 is a cross-sectional view of a concrete foundation with an anchor bolt properly spaced from the outer edge of the foundation and the inner surface of the form board that defines the outer surface of the foundation wall.
Figure 6:
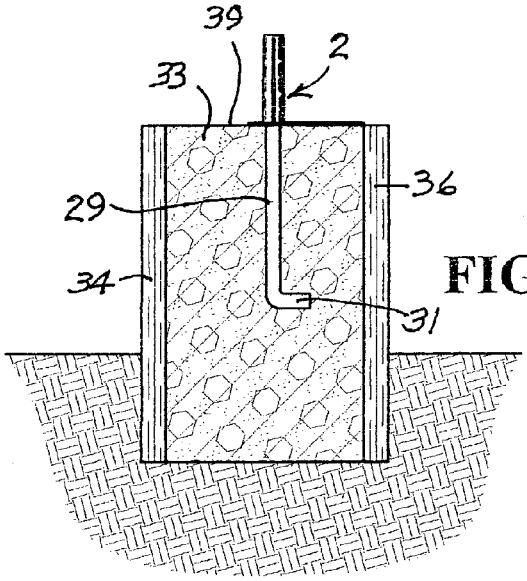
FIG. 6 is side elevational view of the anchor bolt placement device illustrated in FIG. 5, the concrete foundation being shown in cross-section in the interest of clarity.
Figure 8:
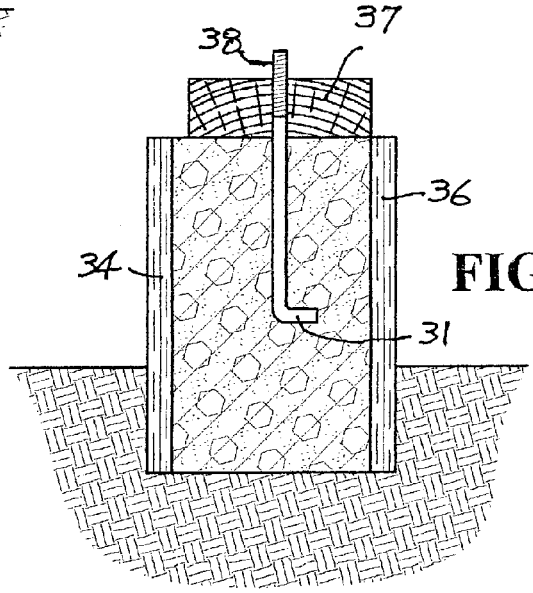
FIG. 8 is a view similar to FIG. 7 and illustrating a 2" by 6" mud sill imposed on the threaded end of the anchor bolt.

Referring to FIGS. 5–8, it will there be seen that the anchor bolt placement device is illustrated in plan in FIG. 5 applied to an anchor bolt 29 imbedded in a concrete foundation wall 33 retained between parallel foundation form boards 34 and 36. Comparing FIG. 5 with FIG. 2, it will be seen that in FIG. 5 the anchor bolt 29 is positioned for penetration of a 2"×6" mud sill 37 as illustrated in FIG. 8. As indicated above, the anchor bolt is spaced to penetrate the mud sill medianly of the width thereof, and is provided with a threaded end portion 38 that projects above the mud sill sufficiently to accept a washer and a retention nut (not shown). Comparing FIGS. 6 and 7, it will be seen that the anchor bolt placement device is detachably secured to the upper threaded end of the anchor bolt 29, is resting by its base on the top surface 39 of the concrete. As seen in FIG. 7, the anchor bolt placement device 2 has been removed from the anchor bolt and the anchor bolt threaded end portion is exposed for application of the mud sill 37 as illustrated in FIG. 8.

Figure 9:
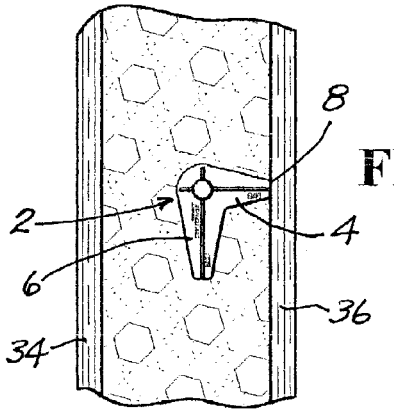
FIG. 9 is a view similar to FIG. 5, but showing the anchor bolt placement device oriented to space the anchor bolt the proper distance from the inner surface of the form board that defines the outer surface of the concrete foundation for reception of a 2"×4" mud sill.
Figure 11:
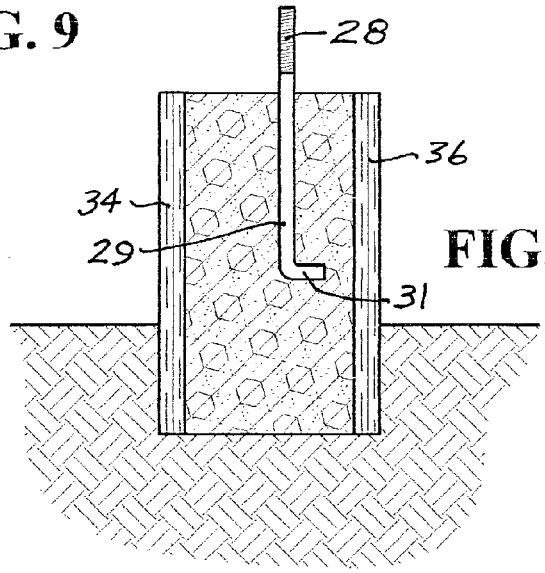
FIG. 11 is a view similar to FIG. 10 but with the anchor bolt placement device removed from the threaded end of the anchor bolt.
Figure 10:
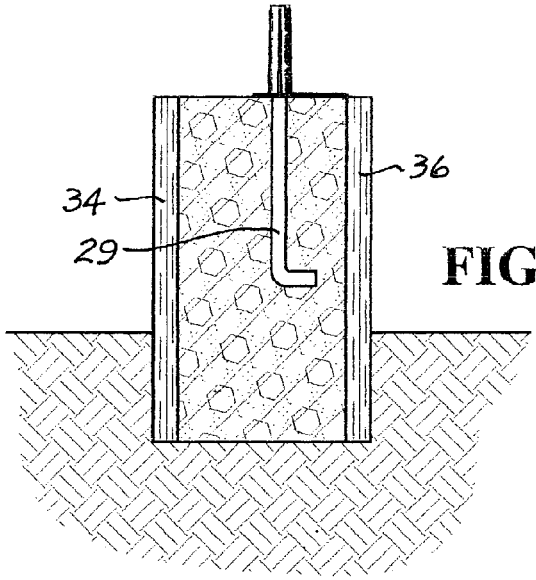
FIG. 10 is a vertical cross-sectional view of the installation of the anchor bolt placement device shown in FIG. 9, the anchor bolt being shown in full lines for clarity.

Referring now to FIGS. 9 through 12, inclusive, it will be seen from FIG. 9 that the anchor bolt placement device 2 is illustrated in plan as positioned on the surface of the concrete with the lateral arm 4 of the anchor bolt placement device and its end 8 positioned against the inner surface of the form board. In this embodiment of the invention, since both lateral extension members 4 and 6 are included, when the anchor bolt placement device is positioned as illustrated in FIG. 9, the 90° position of the extension 6 extends substantially parallel to the associated form board. As discussed above, the placement device 2 functions to properly space the anchor bolt and functions also to prevent contamination of the threads by fresh concrete.

Figure 1:
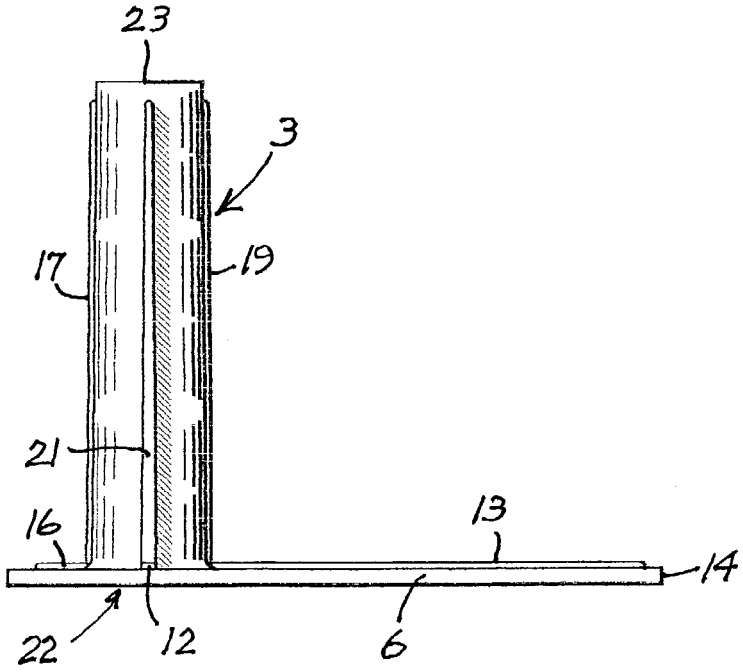
FIG. 1 is a side elevational full size view of one embodiment of the anchor bolt placement device.
Figure 13:
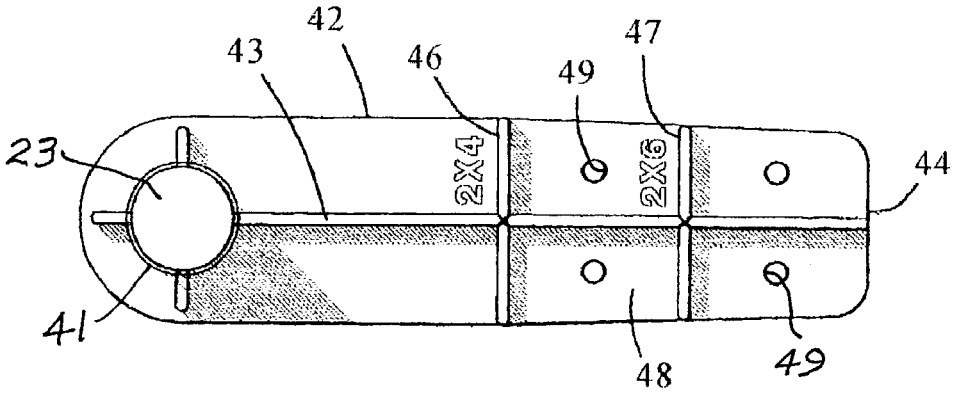
FIG. 13 is a plan view of the second embodiment of the anchor bolt placement device invention, showing a vertical tubular member and an integral lateral extension having crow-ribs and indicia to indicate the appropriate placement of the anchor bolt for both 2"×4" and 2"×6" mud sills.
Figure 13A:
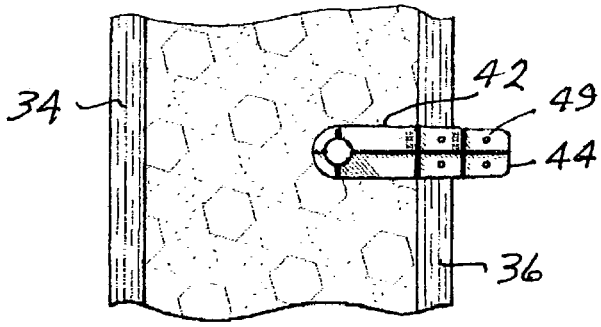
FIG. 13A is a top plan view of the device of FIG. 13 shown temporarily mounted on a form board.
Figure 14:
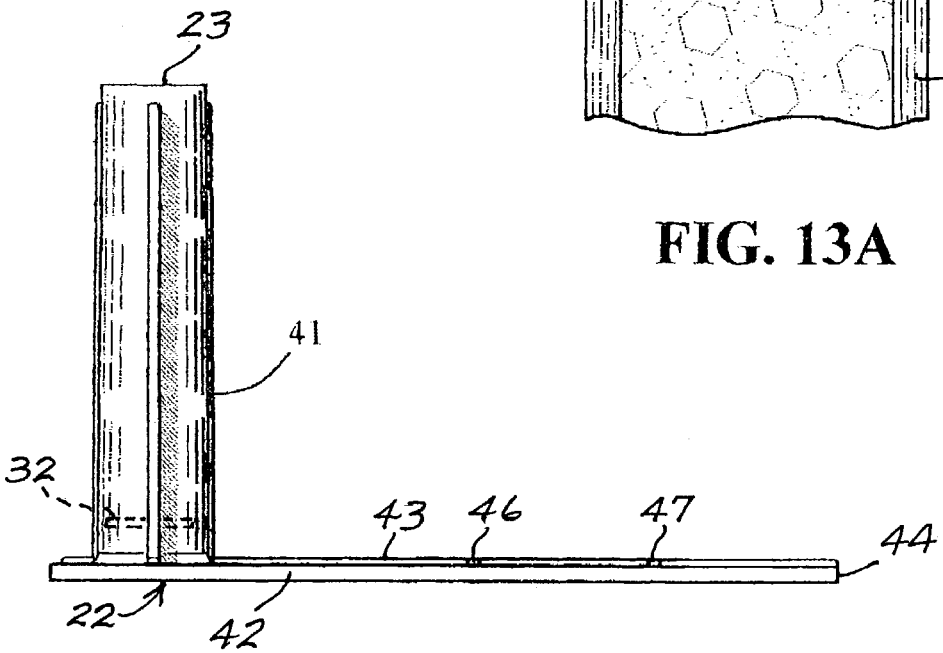
FIG. 14 is a side elevational view of the anchor bolt placement device illustrated in FIG. 13.

From FIGS. 13 and 14, it will be seen that in this second embodiment of the invention the anchor bolt placement device is again provided with a vertically extending tubular member designated generally by the numeral 41, having the same configuration as the tubular projection 3 illustrated in FIG. 4, including the an open bottom end 22, a closed or otherwise terminated end 23, the reinforcing ribs previously mentioned and the radially inwardly projecting annular rib 32 adjacent the open end 22. This embodiment of the invention differs from the embodiment illustrated in FIGS. 1 through 5 in that the measurement means for determining the proper position of the anchor bolt for 2"×4" and 2"×6" mud sills are incorporated in a single laterally projecting elongated plate designated generally by the numeral 42. This is in distinction to the two lateral extensions 4 and 6 spaced 90° apart as illustrated in FIG. 1. Referring to FIG. 13, it will be seen that the single lateral extension plate 42 is provided with a medianly positioned reinforcement rib 43 that terminates at the end edge 44 of the extension 42. In addition, transversely extending spaced integral ribs 46 and 47 are positioned on the surface of the plate member 42 in positions to accurately indicate the position of the anchor bolt for both 2"×4" and 2"×6" mud sills. Note that indicia "2×4" and "2×6" are molded on the surface 48 of the lateral plate extension 42. Additionally, pre-drilled holes 49 adjacent the positioning ribs 46 and 47 of the extension 42 accept nails so that once the anchor bolt placement device and anchor bolt have been set in a selected position designated by the indicia with the anchor bolt embedded in concrete, the nail holes are positioned so that nails may be driven through the holes into the top edge of the form board over which the lateral plate extension 42 projects to temporarily retain the anchor bolt properly located until the concrete hardens. This relationship of the anchor bolt and the placement device are illustrated in FIG. 13A.

Figure 15:
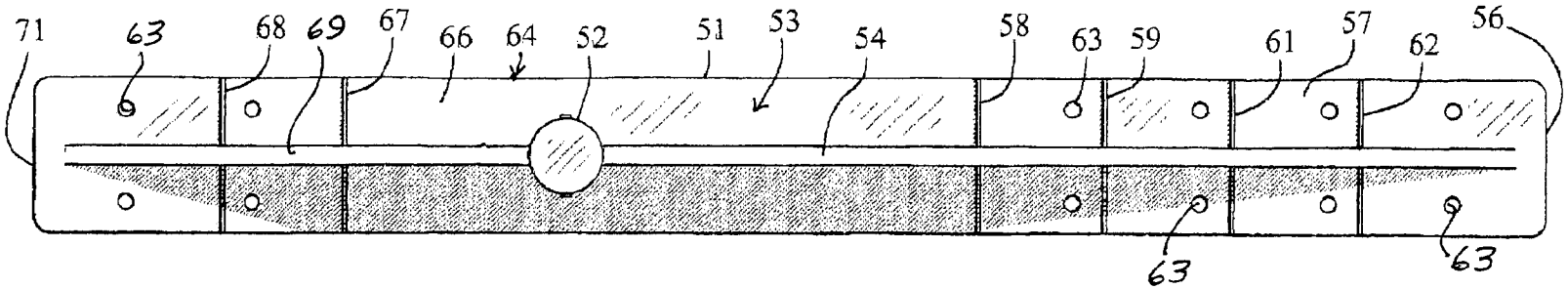
FIG. 15 is a top plan view of a third embodiment of the anchor bolt placement device invention.
Figure 15A:
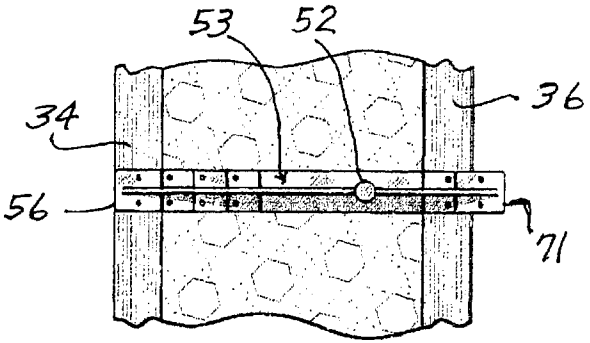
FIG. 15A is a top plan view of the device of FIG. 15 shown temporarily mounted on spaced form boards.
Figure 16:
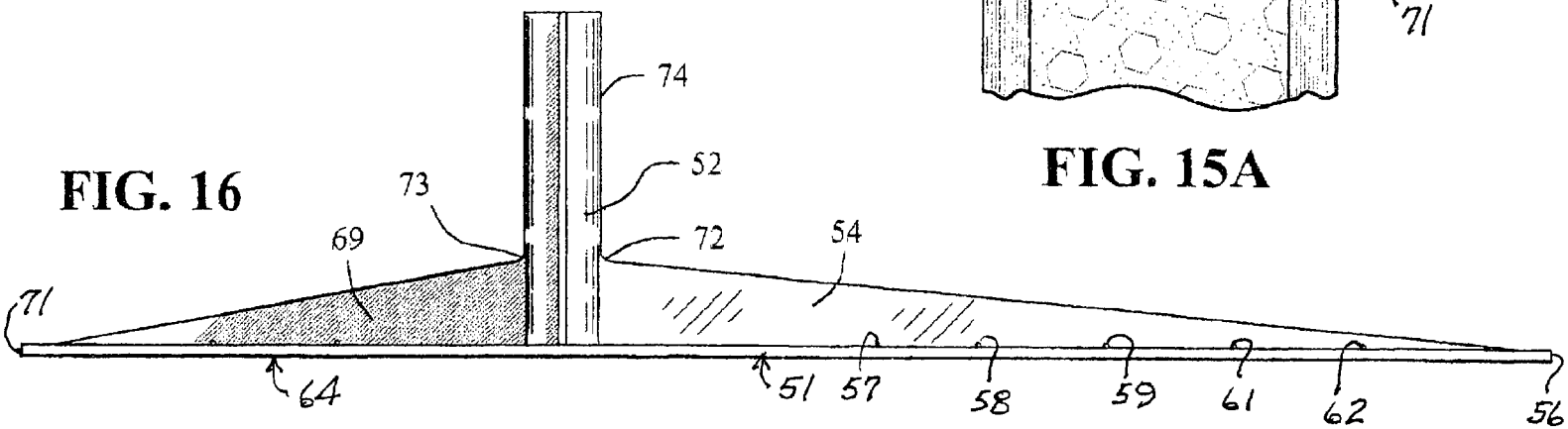
FIG. 16 is a side elevational view of the third embodiment of the anchor bolt placement device invention, illustrating integral lateral extensions on both sides of the vertical tubular projection to properly place the anchor bolt in relation to the outer wall of the foundation, to provide a means for properly spacing and retaining the form boards for a selected thickness of foundation wall, and to protect the threads against contamination by concrete.

Referring to the third embodiment of the invention illustrated in FIGS. 15, 15A and 16, it will be seen that in this embodiment of the invention the lateral extension constitutes an elongated base plate designated generally by the numeral 51 integral with the upwardly projecting tubular member 52 the structure of which is the same as the upwardly projecting tubular member 3 illustrated in FIG. 14. In this embodiment, the elongated base member 51 projects to the right of the upwardly projecting member 52 as seen in FIGS. 15 and 16 in a base portion designated generally by the numeral 53, this portion of the base having a central reinforcing rib 54 that extends medianly of the base to adjacent the end edge 56 of the elongated base member portion 53. Positioned on the top surface 57 of the base member portion 53 are laterally spaced transversely extending position-indicator ribs 58, 59, 61 and 62, each of these ribs being spaced apart one from the other approximately one inch. Note also that between the ribs identified above, there are provided pre-drilled nail holes 63 to receive nails that may be driven into an underlying top edge of a properly positioned form board as previously described.

On the opposite side of the upwardly projecting tubular member 52, i.e., to the left of the tubular member 52 as seen in FIG. 16, the base member 51 is provided with the relatively shorter base member portion designated generally by the numeral 64. The top surface 66 is provided with integral transverse ribs 67 and 68, and a central reinforcing rib 69 that extends from the outer periphery of the upwardly projecting tubular member 52 to adjacent the end edge 71 of the lateral base portion 64. In this embodiment, the ribs 67 and 68 are spaced apart approximately one inch and the overall length of the base member 51 extending on both sides of the upwardly projecting tubular member 52 is approximately twelve inches. To provide additional reinforcement for this elongated base member 51, it is noted that the ribs 54 and 69 merge with the top surface of the base member 51 adjacent the end edges 56 and 71, respectively, but are inclined upwardly to an integral union at 72 and 73, respectively, with the outer tubular surface 74 of the upwardly projecting tubular member 52. These ribs provide the necessary rigidity or resistance to flexure of the elongated base member 51 when it is nailed across the top surface edges of underlying form boards. It will thus be seen in this connection that this single or unitary pre-manufactured anchor bolt placement device as illustrated in FIGS. 15, 15A and 16 not only performs the function of appropriately positioning the anchor bolt in relation to the width of the underlying concrete foundation and form boards but also performs the function of retaining the top edges of the foundation form boards at a selected appropriate spacing (FIG. 15A), both against inward pressure that might be exerted by earth that is filled against the outside surfaces of the form boards but also against outwardly directed pressure of concrete that is poured between the form boards, thus promoting a very accurately dimensioned foundation wall.

Having thus described the invention, what is believed to be new and novel and sought to be protected by letters patent is as follows.

I claim:

1. An anchor bolt placement and protection device for positioning a threaded anchor bolt in a concrete stem foundation or concrete slab in relation to at least one of two spaced form boards that define at least one surface of said concrete stem foundation or concrete slab and for controlling the length of the anchor bolt projecting above the concrete foundation or slab, comprising:

a) an elongated tubular member having a central axis and an upper terminal end, an open lower end symmetrical about said central axis, a predetermined inner peripheral diameter dimensioned to encompass the diameter of a selected anchor bolt and a depth between said terminal end and said open lower end correlated to the length of said anchor bolt that is to project above said concrete stem foundation or concrete slab;

b) an annular rib on the inner periphery of said tubular member dimensioned to frictionally engage the anchor bolt when inserted in said tubular member to allow selective slidability of the elongated member along the anchor bolt in one direction to position and hold the tubular member and in a second direction to enable the tubular member to be removed from the anchor bolt; and c) a base plate having an aperture defining the open end of said elongated tubular member and at least one integral elongated plate portion extending laterally from said tubular member and including top and bottom surfaces and an end edge spaced a predetermined distance from said tubular member central axis.

2. The anchor bolt placement and protection device according to claim 1, wherein said upper terminal end of said elongated tubular member includes means for limiting the penetration of said anchor bolt into said tubular member.

3. The anchor bolt placement and protection device according to claim 1, wherein said device comprises a unitary body fabricated from synthetic resinous material.

4. The anchor bolt placement and protection device according to claim 1, wherein said base plate circumscribes said tubular member central axis, and said at least one integral elongated plate portion extends perpendicularly from said elongated tubular member.

5. The anchor bolt placement and protection device according to claim 1, wherein an integral elongated reinforcement rib is provided medianly of said elongated plate portion extending from adjacent said end edge thereof to said elongated tubular member.

6. The anchor bolt placement and protection device according to claim 1, wherein at least one integral reinforcement rib is provided extending across said root portion from adjacent the perimeter thereof to the outer periphery of said elongated tubular member.

7. The anchor bold placement and protection device according to claim 2, wherein said means limiting penetration of said anchor bolt into said tubular member comprises an abutment formed at the upper terminal end of said tubular member.

8. The anchor bolt placement and protection device according to claim 1, wherein said annular rib on the inner periphery of said tubular member lies adjacent the open end of said tubular member.

9. The anchor bolt placement and protection device according to claim 6, wherein a plurality of integral reinforcement ribs are provided spaced at 90° intervals about said root portion of the base plate.

10. An anchor bolt placement and protection device for positioning a threaded anchor bolt in a concrete stem foundation or concrete slab in relation to at least one form board and for controlling the length of the anchor bolt projecting above the concrete foundation or slab, comprising:

an elongated tubular member having a central axis and an upper terminal end, an open lower end symmetrical about said central axis, and an inner peripheral diameter dimensioned to encompass the diameter of the anchor bolt, the tubular member having a depth between said upper terminal end and said open lower end correlated to the length of the anchor bolt that is to project above the concrete stem foundation or concrete slab;

a base plate having a root portion integral with the open end of said elongated tubular member;

an aperture in the root portion of said base plate coincident with the open end of said tubular member;

at least two integral elongated plate portions extending laterally from said root portion of said base plate and perpendicular to one another and to said central axis of said elongated tubular member and integral with said root portion of said apertured base, said plate portions each including top and bottom surfaces and an edge spaced a predetermined distance from said central axis; and further including an annular rib in said elongated tubular member dimensioned to frictionally engage an anchor bolt thrust thereinto.

11. An anchor bolt placement and protection device for positioning a threaded anchor bolt in a concrete stem foundation or concrete slab in relation to at least one form board and for controlling the length of the anchor bolt projecting above the concrete foundation or slab, comprising:

an elongated tubular member having a central axis and an upper terminal end, an open lower end symmetrical about said central axis, and an inner peripheral diameter dimensioned to encompass the diameter of the anchor bolt, the tubular member having a depth between said upper terminal end and said open lower end correlated to the length of the anchor bolt that is to project above the concrete stem foundation or concrete slab;

a base plate having a root portion integral with the open end of said elongated tubular member;

an aperture in the root portion of said base plate coincident with the open end of said tubular member;

at least two integral elongated plate portions extending laterally from said root portion of said base plate and perpendicular to one another and to said central axis of said elongated tubular member and integral with said root portion of said apertured base, said plate portions each including top and bottom surfaces and an edge spaced a predetermined distance from said central axis; and wherein integral reinforcement ribs are spaced about the outer periphery of said elongated tubular member at 90° intervals and extend from said root portion of said base plate to adjacent said upper terminal end of said elongated tubular member.

* * * * *